US006802415B2

(12) United States Patent
Loeffler

(10) Patent No.: US 6,802,415 B2
(45) Date of Patent: Oct. 12, 2004

(54) ADVERTISING QUADRATE CARRIER ASSEMBLY WITH PREMIUM CRADLE

(75) Inventor: James P. Loeffler, Elk River, MN (US)

(73) Assignee: General Mills, Inc., Minneapolis, MN (US)

( * ) Notice: Subject to any disclaimer, the term of this patent is extended or adjusted under 35 U.S.C. 154(b) by 130 days.

(21) Appl. No.: 10/172,401

(22) Filed: Jun. 14, 2002

(65) Prior Publication Data

US 2003/0230508 A1 Dec. 18, 2003

(51) Int. Cl.[7] ..... B65D 25/54
(52) U.S. Cl. ..... 206/216; 206/459.5; 229/162.1
(58) Field of Search ..... 206/459.5, 775, 206/776, 777–778, 782, 783, 308.1, 461, 756, 769; 229/162.1

(56) References Cited

U.S. PATENT DOCUMENTS 2,550,417 A * 4/1951 Klein ..... 229/162.1
2,643,811 A * 6/1953 Bolding ..... 229/162.1
2,749,017 A * 6/1956 Kravitz ..... 206/775
3,517,801 A * 6/1970 Cote ..... 206/779
3,770,116 A * 11/1973 Cote ..... 206/780
4,925,087 A * 5/1990 Ostrander ..... 206/775
5,005,701 A * 4/1991 Dutcher ..... 206/775
5,375,700 A * 12/1994 Joss et al. ..... 206/775
5,379,886 A 1/1995 Brauner
6,070,719 A * 6/2000 Pollock ..... 206/459.5
6,145,665 A * 11/2000 Krahn ..... 206/769
6,173,833 B1 1/2001 Strehlow

* cited by examiner

*Primary Examiner*—Luan K. Bui
(74) *Attorney, Agent, or Firm*—John A. O'Toole; Douglas J. Taylor

(57) ABSTRACT

The present invention relates to a quadrate carrier advertising assembly that has a cradle for supporting an advertising piece, promotional item or premium. The advertising quadrate assembly is provided as an intermediate vehicle that is intended to be complimentary to consumer products intended for sale. The quadrate carrier of the present invention permits the premium to be visible.

14 Claims, 10 Drawing Sheets

ADVERTISING QUADRATE CARRIER ASSEMBLY WITH PREMIUM CRADLE

CROSS-REFERENCES TO RELATED APPLICATIONS

None.

BACKGROUND OF THE INVENTION

The present invention relates to a quadrate carrier advertising assembly having a cradle for supporting an advertising piece, promotional item or premium. The advertising quadrate assembly is provided as an intermediate vehicle that is intended to be complimentary to consumer products intended for sale.

Today's consumer is faced with a myriad of choices in connection with purchasing goods and services. Product packaging and advertising has virtually taken on a life of its own with respect to attempting to drive more sales of the product that is supported by such activity. This is particularly true in areas where product lines are viewed as mature and manufacturers use additional incentives to drive more sales out of their product offering.

Many premiums or other advertising or incentive items are commonly packaged within the product package itself. That is, the premium is actually placed in the package and depending on the size of the premium, the premium may displace volume of the product, which normally is within the package. This leads the manufacturer having to potentially create a larger product package to ensure the proper amount or volume of product is going in the package to make up for the volume displaced by the premium.

Where the premium is physically placed within the product package, such as within a cereal box, the premium, while wrapped in a protective film can become covered in product dust or crumbs making use or removal of the premium undesirable. Moreover, such placement leads to a number of other undesirable consequences.

Many premiums are targeted at children, and there is the tendency of a child to remove the premium prior to use of the contents of the package. This may include anything from a child emptying the contents of the package out on a kitchen counter to get the prize or premium that has settled to the bottom of the box or inserting ones hand deep within the box to retrieve the premium. In either event, obtaining the premium leads to unsanitary situations and potential product spoilage.

Another solution in providing premiums on packaging for the consumer has been to modify the physical product package itself. That is, external pockets or sleeves are added to the package or other special additions are made to the package in order accommodate the premium. The addition of such special constructions adds another layer of cost to the manufacturing of the product as well as potentially slows the manufacturing operation down in order to provide the package with the additional auxiliary structures or features.

A still further manner to provide premiums with packages has been to create cut out portions of the package, wherein the consumer in order to remove the premium must physically cut or remove a piece of the product package. If the premium is removed prior to the contents of the package being emptied, the contents may become stale upon exposure to air. Alternatively, where the premium is part of the packaging itself, removal of the premium, if one is not careful, can cause any inner barrier layer or enclosure, such as is found with a ready to eat ("RTE") cereal like COCOA PUFFS®, available from General Mills, Inc. Minneapolis, Minn., to be cut or damaged in the removal process. This can lead to product spoilage and spillage.

In addition, many premiums are included only with a single package thereby increasing the cost of providing the product to the market. In the alternative, if the cost of the premium is allocated to a single product package the value of the premium is often trivial leading to a give away that either may diminish the product offering or disappoint the consumer both of which create an undesirable result.

Where the retailer desires to include more substantial premiums with the product offering, the weight of the premium, if affixed externally may cause the product package to fall over when on the retail shelves. Perhaps more importantly, the size or bulkiness of a premium when affixed externally can cause difficulties in stacking, and stocking products on the shelves, leading to retailer frustration and possibly early cessation of the promotion by the retailer.

One solution to such a problem of providing enhanced value premiums has been to provide an image of the premium on the surface of the product package, and conceal the premium within the package. This unfortunately can lead to either disbelief by the consumer, or that something such as additional purchases are required in order to obtain the premium or outright theft of the premium and resealing of the product package such that it appears that the premium is still contained within the package.

As so many premiums are directed at children, the use of premiums in product marketing has generally overlooked a large segment of the consuming public, adults. However, adults typically would not be induced to make a purchase by providing premiums in a traditional fashion, or at least they don't want to be seen diving into the bottom of a box to capture the premium. Moreover, as such premiums are generally inexpensive, today's typically premiums generally do not attract adult consumers.

There is a need for a system by which a premium can be provided that avoids the aforementioned drawbacks as well as stimulates sales of products and draws new attention and consumers to the product offering. In addition, by providing an arrangement in which the cost of the premium can be allocated over several product packages, a more valuable premium can be offered while as the same time increasing product sales.

As used herein, the terms "premium", "advertising piece" and "promotional item" refer to a supplemental product, prize, gift or other item or giveaway, which may accompany the product being advertised in order to stimulate sales or promote an event but is not party of the regular product offering.

BRIEF SUMMARY OF THE INVENTION

In a first embodiment of the present invention, a quadrate assembly is provided and comprises at least first, second, third and fourth panels. The first panel has first and second longitudinally extending sides and first and second transversely extending end edges. At least one of the first and second end edges has a tab that extends in a longitudinal direction. The first panel also has first and second faces which comprise substantially the dimension of the first panel.

The second panel of this initial embodiment has first and second longitudinally extending sides and first and second transversely extending end edges. At least one of the first and second end edges has a partially die cut tab that extends longitudinally from the end edge. The second panel is connected to the first panel along one of the first and second longitudinally extending sides. The second panel has first and second faces creating a dimension that is distinct from the dimension of the first panel.

The third panel of this embodiment also has first and second longitudinally extending sides and first and second transversely extending end edges. The third panel has a tab extending longitudinally from at least one of the first and second end edges. The third panel is connected to the second panel along one of the first and second longitudinally extending sides. The third panel has first and second faces and the third panel has a dimension substantially equal to that of the first panel.

The fourth panel of this embodiment has first and second longitudinally extending sides and first and second transversely extending end edges. The fourth panel has a first tab extending longitudinally from one of the first and second end edges. The fourth panel has a second tab extending from one of the first and second longitudinally extending sides. The fourth panel is connected to the third panel along one of the first and second longitudinally extending edges opposite the second tab. The fourth panel has first and second faces and the fourth panel has a dimension that is greater than the dimension of the first panel.

The present embodiment also has a die cut window in one of the panels. One of the panels also has a moveable tab which fits over but does not conceal the die cut window so as to enable as advertising premium to be supported in the assembly and be visible.

In a still further embodiment of the present invention an intermediate assembly is described and includes a substantially quadrate blank of material that has first, second, third and fourth panels.

The first panel has first and second longitudinally extending sides and first and second transversely extending end edges. The first end edge has a tab extending in a longitudinal direction. The second end edge is substantially devoid of any tabs. The first panel has first and second faces, and the first panel has a first dimension.

The second panel of this embodiment has first and second longitudinally extending sides and first and second transversely extending end edges. The first end edge has a tab extending longitudinally from the first end edge and the second end edge is substantially devoid of any tabs or flaps. The second panel is connected to the first panel along one of the first and second longitudinally extending sides. The second panel has first and second faces and the second panel has a second dimension that is distinct from the dimension of the first panel.

The third panel of this embodiment has first and second longitudinally extending sides and first and second transversely extending end edges. The third panel has a tab extending longitudinally from the first end edge and has a tab that extends in a longitudinal direction. The second end edge is substantially devoid of any tabs or flaps. The third panel is connected to the second panel along one of the first and second longitudinally extending sides. The third panel has first and second faces and the third panel has a dimension that is substantially equal to one of the dimensions of the first and second panels.

The fourth panel of this embodiment has first and second longitudinally extending sides and first and second transversely extending end edges. The fourth panel has a first tab extending longitudinally from the first end edge having a tab that extends in a longitudinal direction. The second end edge is substantially devoid of any tabs or flaps. The fourth panel is connected to the third panel along one of the first and second longitudinally extending edges opposite the second tab. The fourth panel has first and second faces and the fourth panel has a dimension substantially equal to one of the dimensions of the first and second panels.

This current embodiment also includes a die cut window that is in one of the first, second, third and fourth panels. The die cut window is sized and configured to receive a premium.

This embodiment also provides that at least one of the tabs of the first, second, third and fourth panels has a first die cut therein that is sized and configured to cooperate with the die cut window. The tab is moveable into cooperative engagement with the die cut window. The tab also has a second die cut area that facilitates placement of the premium in the assembly.

In a still further embodiment a quadrate assembly is described and comprises at least first, second, third and fourth panels. The first panel has first and second longitudinally extending sides and first and second transversely extending end edges. At least one of the first and second sides has a first partially die cut tab that extends transversely from the side. The first die cut tab has a hinge that bisects the die cut tab into first and second sections. The first panel has first and second faces, and the first panel has a first dimension. The first panel further includes a second tab, that extends longitudinally from one of the first and second end edges.

The second panel of this embodiment has first and second longitudinally extending sides and first and second transversely extending end edges. The second panel has a tab that extends longitudinally from one of the first and second end edges. The second panel is connected to the first panel along one of the first and second longitudinally extending sides. The second panel has first and second faces and the second panel has a second dimension that is distinct from the first dimension.

The third panel of this embodiment has first and second longitudinally extending sides and first and second transversely extending end edges. The third panel has a tab that extends longitudinally from at least one of the first and second end edges. The third panel is connected to the second panel along one of the first and second longitudinally extending sides. The third panel has first and second faces and the third panel has a dimension substantially equal to the first panel.

The fourth panel of the present embodiment has first and second longitudinally extending sides and first and second transversely extending end edges. The fourth panel has a tab that extends longitudinally from one of the first and second end edges. The fourth panel is connected to the third panel along one of the first and second longitudinally extending sides. The fourth panel has first and second faces and the fourth panel has a dimension that is less than the dimension of the first panel.

One of the first, second, third and fourth panels has a die cut window therein and another of the panels, that does not have the die cut window, has a moveable tab which fits over but does not conceal the die cut window so as to enable as advertising premium to be supported in the assembly and be visible.

The present invention is now illustrated in greater detail by reference to the detailed description, but it should be understood that the present invention is not to be construed as being limited thereto.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
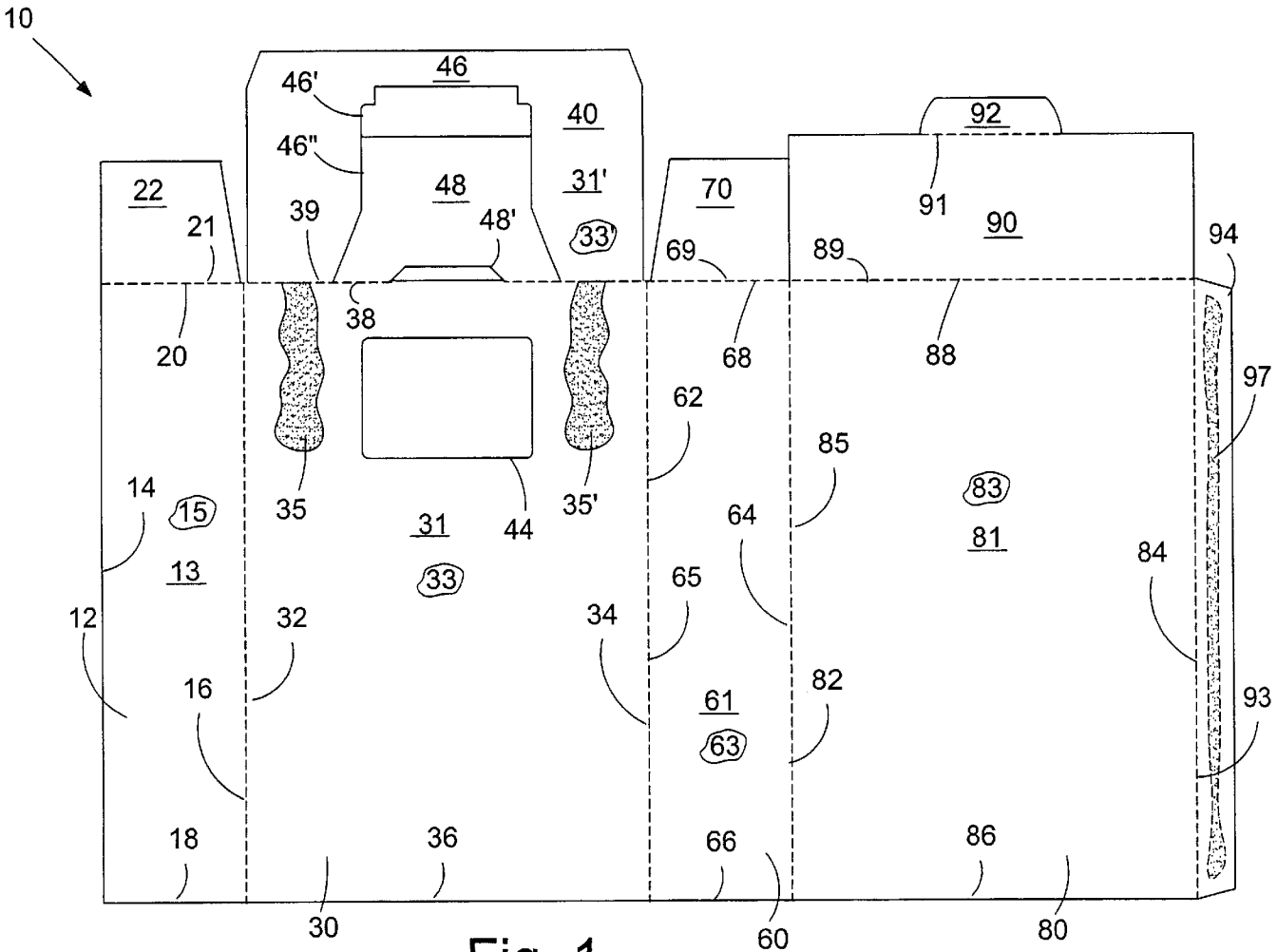
FIG. 1 is a view of the quadrate assembly in an unfolded condition.

The quadrate advertising assembly of the present invention is shown generally in FIG. 1 and designated by reference numeral 10. The assembly 10, is formed from an intermediate blank of substantially quadrate material and includes a first panel 12 having first and second longitudinally extending sides 14 and 16 and first and second transversely extending ends edges 18 and 20. The first panel 12 has first and second faces 13 and 15. The first panel 12 has a tab 22 which extends in the longitudinal direction from one of the first and second end edges 18 and 20. As illustrated in FIG. 1, tab 22 is connected to end edge 20 and extends outwardly there from. Tab 22 may be provided with a hinge or score line 21, by which the tab 22 can be folded about the connected end edge 20. The first panel 12 has a first dimension, which is defined by the area bounded by sides 14 and 16 and end edges 18 and 20.

The quadrate assembly 10 of FIG. 1 has a second panel 30, which has first and second longitudinally extending sides 32 and 34 and first and second transversely extending end edges 36 and 38. A partially die cut tab 40 extends outwardly from one end edge 38 of second panel 30. The second panel is provided with first and second faces 31 and 33. Tab 40, has first and second faces and these are designated as 31' and 33'. The second panel has a dimension which is created by the area of sides 32 and 34 and end edges 36 and 38. The second panel 30 is connected to the first panel 12 and at sides 32 and 16.

Tab 40 is connected to the edge 38 by a hinge or score line 39 that enables the tab 40 or a portion thereof to be folded about the end 38 into a face-to-face engagement with panel 30. That is face 31' of the tab 40 is brought into engagement with face 31 of second panel 30. In order to secure the tab 40 to the second panel 30, strips of adhesive 35 and 35' are provided to either permanently or removably secure at least a portion of tab 40 to second panel 30.

Figure 3:
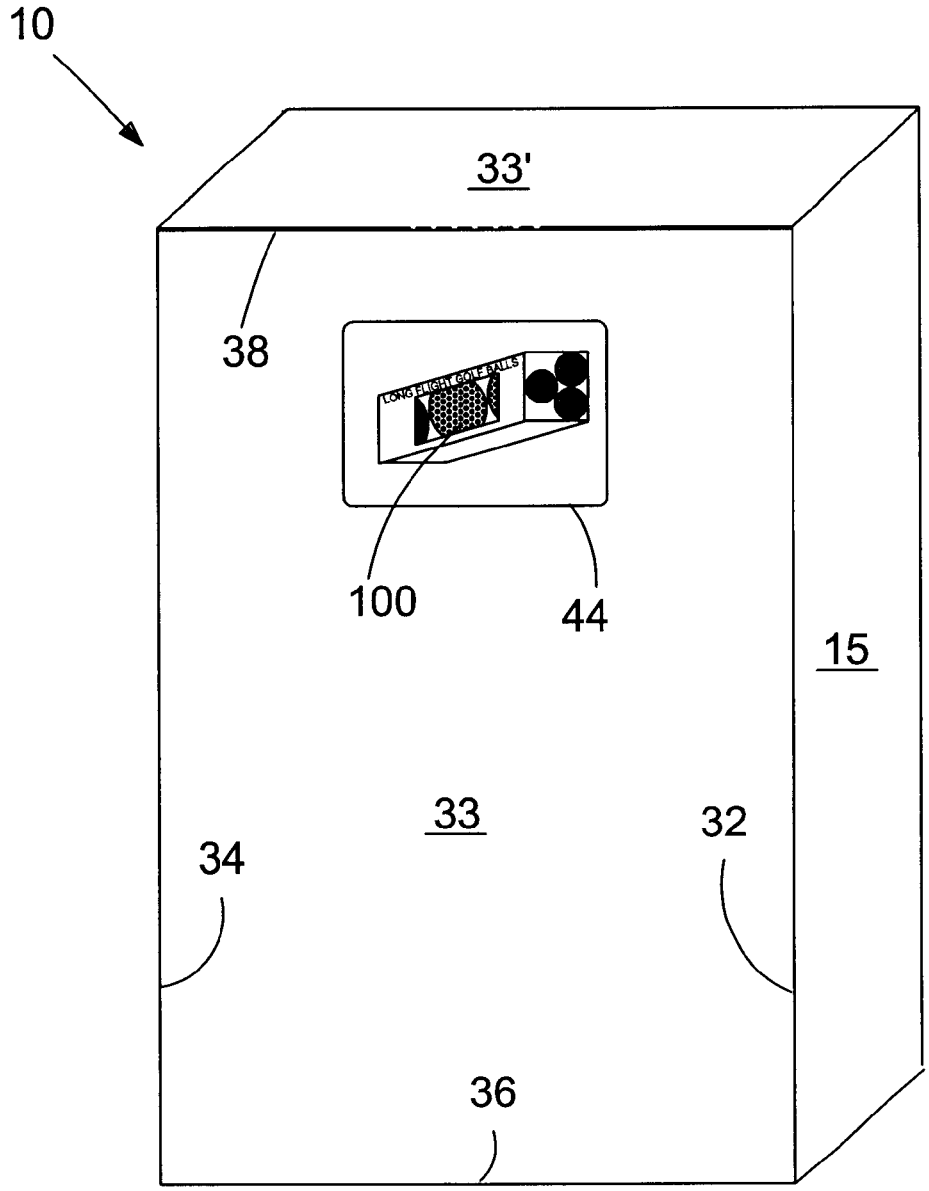
FIG. 3 is an illustration of the quadrate assembly in a folded arrangement and showing the premium.

Second panel 30 has a die cut or window 44 made therein which is sized and configured to accommodate a premium 100 illustrated in FIG. 3. In this instance, the premium 100 is a sleeve of golf balls, but other premiums may be offered, such as toys, cars, dolls, figurines, dish ware, silverware, cassette and video tapes, CD-ROMS, memorabilia and other items where there is a desire, need or benefit to physically show the premium 100 to the prospective consumer, rather than merely providing an image of the premium on the product or retail package.

As mentioned previously, and as illustrated in FIG. 1A, the tab 40 is partially die cut to create moveable flaps or portions 46 and 48. The flaps or portions 46 and 48 can be moved or pivoted about single hinge 38. In the present invention, flap 46 is brought into contact with the face 31 of second panel 30. The die cut in flap 46 is sized and configured so that it will fit over die cut or window 44 and not obscure the window 44 when flap 46 is sealed over window 44 on to panel 30. In addition to the die cut 46' in flap 46, has an additional area that is removed to create a slot 46" that is capable of receiving an insert to hold the premium 100 in position.

The insert may be constructed of transparent material so that the premium is visible in the window or alternatively, the insert may be opaque so as to create a mystery premium 100. In addition, the insert may also have an opaque scratch off coating allowing the consumer to remove the coating to reveal the premium 100 without having to remove the insert from the assembly 100. In the example of the present invention, the insert encases the premium which permits the premium from being tampered with.

Second flap 48 is provided with a second cut out 48' which is sized and configured to receive tab 92. The cut out slot 48' for the purposes of this invention is in the form of a trapezoid to facilitate ease of movement of tab 92 into cut out 48'. However, any geometric shape may be provided in order to secure the tabs together.

The third panel 60 is provided with first and second longitudinal sides 62 and 64 and first and second end edges 66 and 68. Extending from end edge 68 is a tab 70 which extends longitudinally from the end edge 68. Tab 70 is moveable about a hinge 69. Panel 60 has a first face and a second face 61 and 63, respectively, and a dimension that is defined by the area contained within sides 62 and 64 and end edges 66 and 68. The third panel 60 is connected to the second panel 30 along side 62 and 34, respectively.

A fourth panel 80 has first and second longitudinal sides 82 and 84, and first and second transversely extending end edges 86 and 88. Fourth panel 80 is also provided with a tab 90 that is connected to the fourth panel on end edge 88. Tab 90 is moveable about a hinge or score line 89. Tab 90 is provided with an extension 92 that is foldable about a hinge 91. Panel 80 has a second tab 94 that extends in the longitudinal direction and is connected to side 84. Tab 94 is moveable about a hinge 93. The fourth panel 80 is connected to the third panel 60 along sides 82 and 64, respectively.

The fourth panel is provided with first and second faces 81 and 83 and has a dimension that is defined by the area contained within sides 82 and 84 and end edges 86 and 88.

Each of the faces of the panels or only selective faces of the panels may be printed or imaged with indicia, graphics or the like, hereinafter "indicia." That indicia may relate to the product that is being sold in connection with package; advertising indicia related to the event being promoted; carry information relating to the product or premium being offered and the like. In addition, such indicia may be in the form of a coupon, gift certificate or the like, such as for free car services, discounts off product purchases and the like. It is important that the quadrate assembly 10, be integrated with the promotion and the retail products so that it appeals to the intended consumer.

The dimension of the third panel 60 is substantially equal to the dimension of first panel 12. The dimension of panel 30 and panel 80 is substantially greater than the dimensions of either panels 12 and 60. The dimension of the fourth panel 80 is substantially equivalent to the dimension of the second panel 30.

Figure 1A:
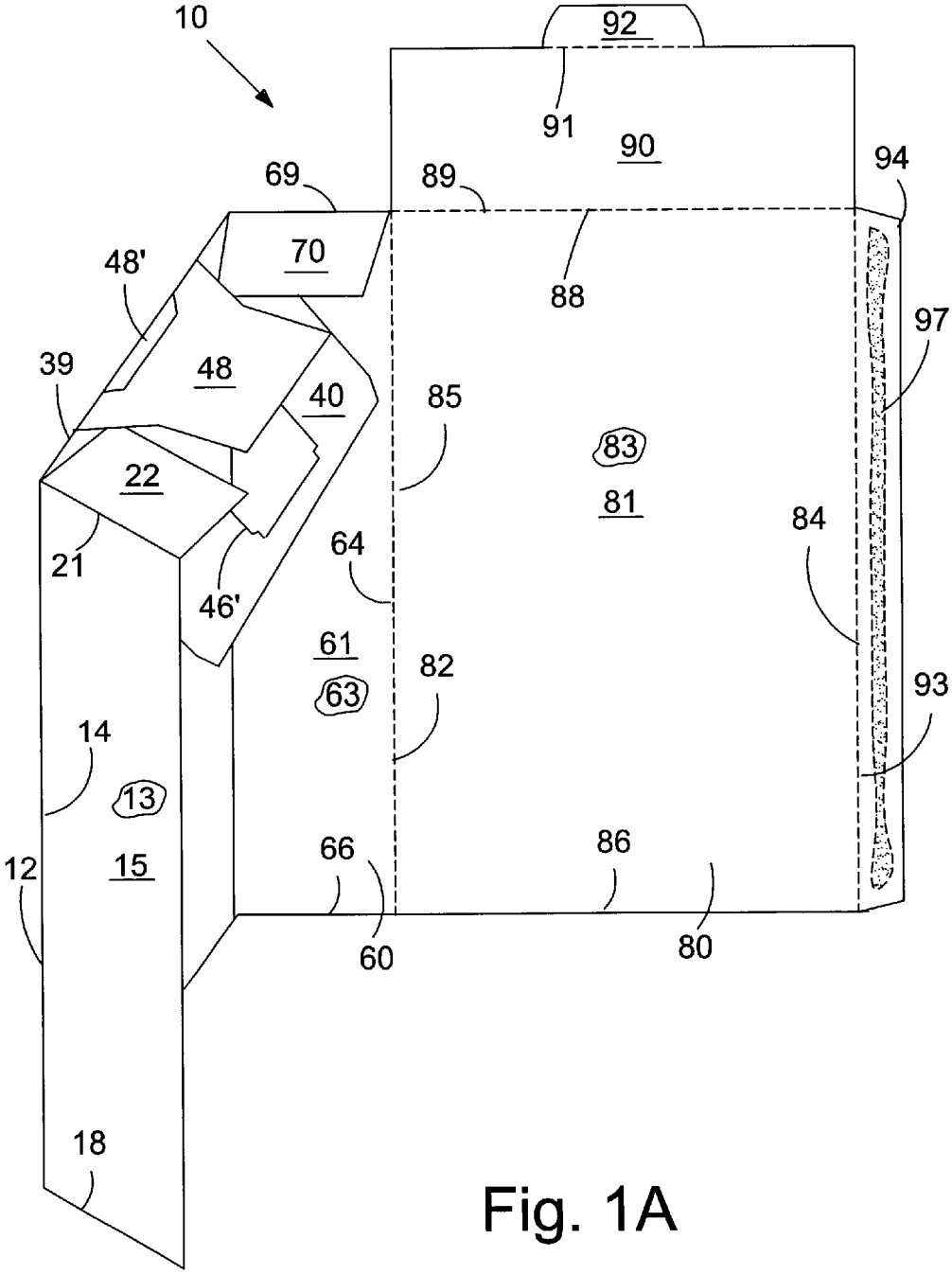
FIG. 1A is a partially folded view of the quadrate assembly.
Figure 2:
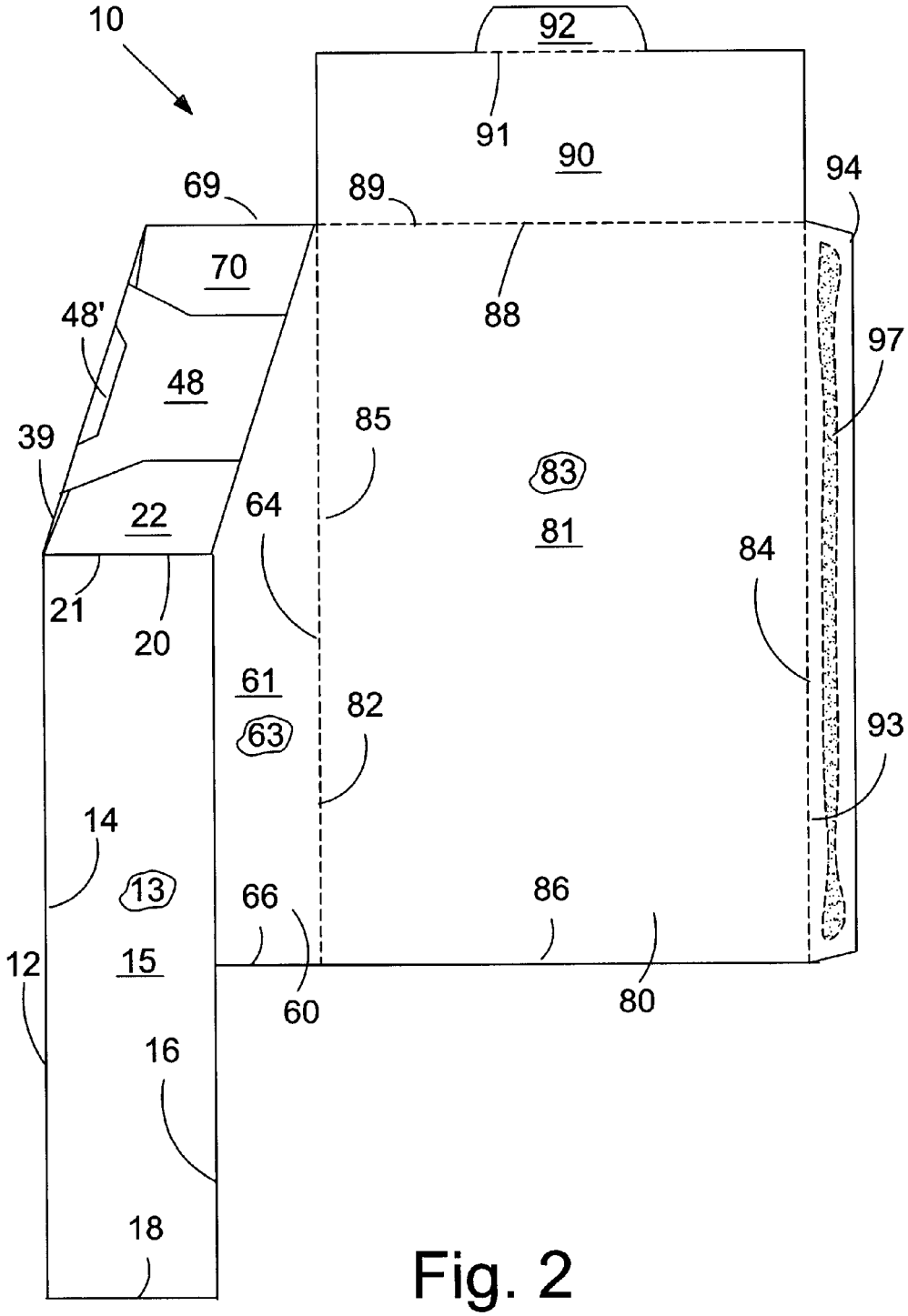
FIG. 2 is a view of the quadrate assembly illustrating the quadrate assembly in a further partially folded condition.

In a preferred embodiment, and as illustrated in FIGS. 1A and 2, second flap 48 of second panel 30 is folded about hinge 39 such that flap 48 is in a perpendicular position to panel 30. First flap 46 has been folded into face to face contact with panel 30. Likewise, in a folded condition tab 22 of panel 12 is also folded about hinge 21 so as to be in a perpendicular position to that of panel 12. Panel 12 is then folded about hinge 16 so as to be in a perpendicular position with respect to panel 30. This brings tab 22 into proximate contact with second flap 48.

Next, and referring to FIG. 2 tab 70 is folded about hinge 68 so that it is perpendicularly positioned with respect to panel 60. Panel 60 is then folded about hinge 65 so as to be perpendicularly positioned with respect to panel 30. Tab 70 is then in proximate contact with second flap 48.

The fourth panel 80 is then folded about hinge 85 so that it is perpendicular to panels 60 and 12 and covering over the top of panels 60 and 12. Second tab 94 is brought into operative association with panel 12 by folding the tab 94 about hinge 93. A line of adhesive 97 is applied to one face of tab 94 to secure tab 94 to panel 12.

Tab 90 is then folded about hinge 89 and brought into operative association with tabs 70 and 22 as well as second flap 48. In addition the extension 92 is folded about hinge 91 and pressed into die cut slot 48'.

With this configuration, as illustrated in FIG. 3, the quadrate assembly 10 has been formed. The quadrate assembly 10 while having a top formed of tab 90, tab 70, tab 40 and tab 22, is bottomless and hence provides an opening into the interior of the assembly 10. Additional glue lines or spot adhesives may be used to secure the tabs 90, 90, 40 and 22 in position.

In a second embodiment, the description again proceeds left to right with the quadrate assembly 10 in an open position and the flaps or tabs that will form the closure at the top of the assembly and to the sides of the assembly blank 10. As in the first embodiment no tabs or flaps are provided along one edge, as shown in FIGS. 1 and 4 the edge that is substantially devoid or free of tabs or flaps is the bottom end edge or the second end edge of each of the panels.

Figure 4:
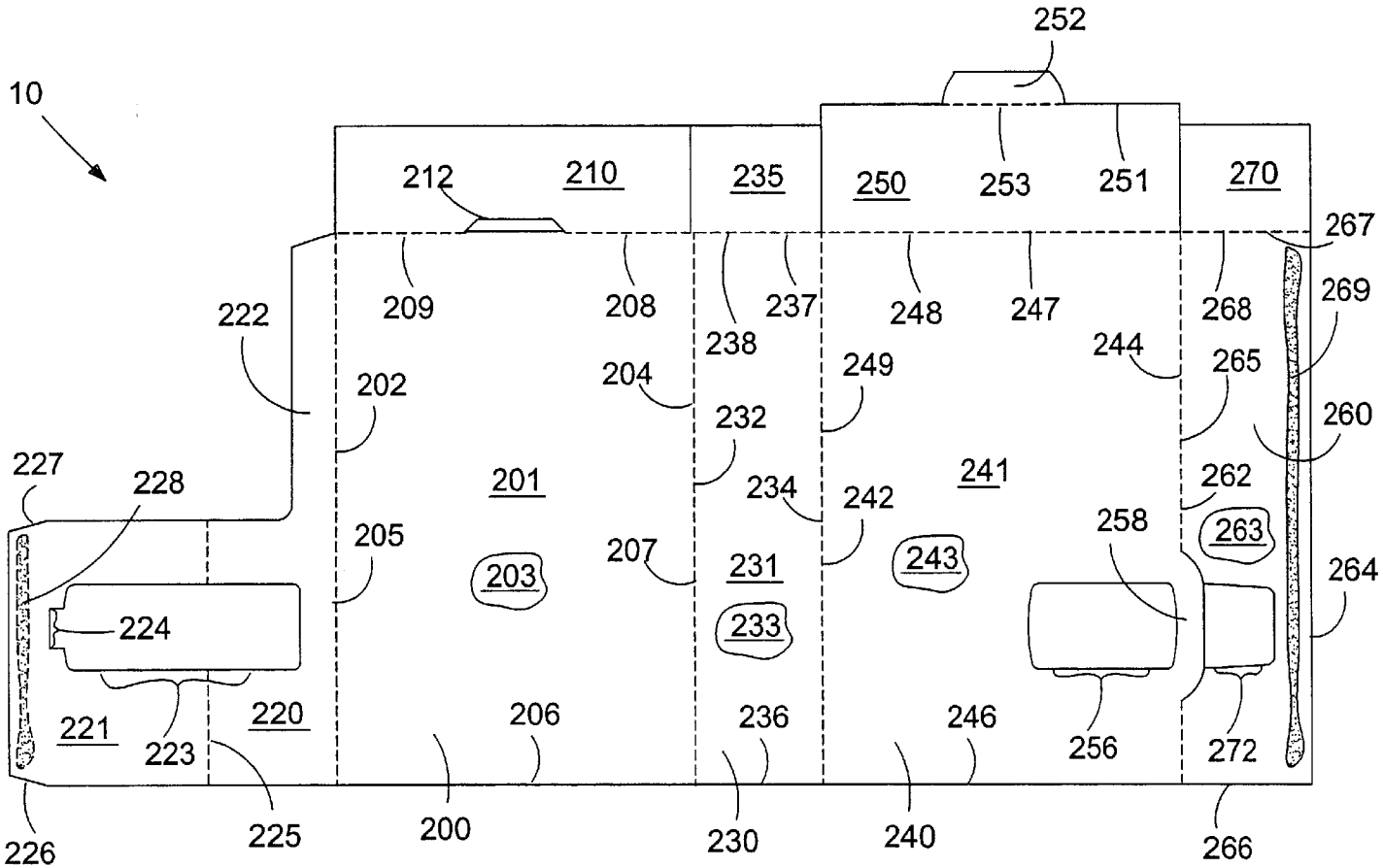
FIG. 4 is an illustration of an alternative embodiment of the quadrate assembly in an unfolded condition.

Turning now to FIG. 4, the quadrate assembly 10 of the second embodiment includes a first panel 200 having first and second longitudinally extending sides 202 and 204 and transversely extending end edges 206 and 208. The first panel 200 includes a tab 210 that extends longitudinally outwardly from the end edge 208 and in the transverse direction. Tab 210 is provided with a die cut 212 which is in the form of a trapezoid to accommodate a closure flap. Tab 210 is pivotable about a hinge or score line 209.

The first panel 200 has first and second faces 201 and 203 which make up the dimension of the first panel 200 that is bounded by the sides 202, 204 and end edges 206, 208.

The first panel 200 is provided with longitudinally extending hinges or score lines 205 and 207. Hinge 207 connects the first panel 200 to a second panel 230 while hinge 205 connects the first panel to an extension 220.

As seen in FIG. 4, extension 220 is composed of two sections, a main section 221 which extends transversely out from side 202 of first panel 200 and a joining section 222 that extends generally in the longitudinal direction and is joined to first panel 200 along side 202. The main section 221 comprises the majority of extension 220 and is provided with die cut area 223. While the die cut area 223 as illustrated in FIG. 4 has a length greater than its width and distal end 224 which aids in forming a pocket to hold an insert for a premium 100, it should be understood that the die cut area 223 may have equal lengths and width, or a larger width than length or any derivation thereof in order to accommodate the premium 100. In any event, the FIG. 4 illustrates that the die cut area 223 is configured to be either slightly larger than the window 256 over which it is placed on third panel 240 or roughly equivalent of the window 256. Where appropriate, the die cut area 223 may also be smaller than the window opening so that additional or complimentary graphics may be included and are visible through the opening or window in panel 240.

Main section 221 is provided with a hinge or score line 225 which is located non-centrally of the section 221. The positioning of this hinge divides the main section into two parts one of which is approximately equal to the width of second panel 230. As illustrated in FIG. 4, extension 220 is provided with tapered ends 226, 227 to facilitate folding of the quadrate assembly 10.

The second panel 230 has first and second longitudinally extending sides 232, 234 and first and second transversely extending end edges 236, 238. Second panel 230 is also provided with first and second faces 231, 233. Second panel 230 has a tab 235 that extends longitudinally from the transverse end edge 238. Tab 235 is connected to end edge 238 along hinge 237. Hinge 237 permits tab 235 to be folded about the hinge during the folding process to complete quadrate assembly 10. The first panel 200 and the second panel 230 are connected on to another alone sides 204 and 232 and are pivotable about hinge 207.

Still referring to FIG. 4, the quadrate assembly 10 of the second embodiment includes a third panel 240. The third panel 240 has first and second longitudinally extending sides 242, 244 and transversely extending end edges 246, 248. The third panel has first and second faces 241 and 243.

The third panel 240 has a tab 250 that extends longitudinally outward from the transverse end edge 248. Tab 250 is connected to the third panel 240 via a hinge 247 which permits the tab 250 to be pivoted about end edge 248. Tab 250 has a further extension 252 that extends longitudinally away from an end edge 251 of tab 250 and is connected to tab 250 via a hinge 253 about which the extension 252 may be pivoted. The extension 252 as illustrated in FIG. 4 is provided centrally of the tab 250, but may be positioned in different areas to accommodate different assembly or folding scenarios as required by the manufacturer. The extension 252 is sized and configured so as to fit within the die cut 212 on tab 210 of first panel 200.

The third panel 240 also includes a die cut or window 256 and as illustrated in FIG. 4, the window is centrally offset so as to be closer to longitudinal side 244. Again, depending on the requirements of the construction and the promotion being offered at the time, the positioning of the window 256 may be moved from the location illustrated in the FIGURES.

As illustrated, the window 256 has rounded edges that facilitate the insertion of the premium 100 and/or its carrier into the window 256.

As illustrated in FIG. 4, third panel 240 is provided with a crescent shaped extension 258 which extends beyond the periphery of the window 256 and beyond the outer side of longitudinal side 244. This extension 258 provides structural support to the window 256 after a premium 100 has been inserted therein. In addition, extension 258 may serve the additional benefit of creating an alignment means when the quadrate assembly 10 is positioned in the retail sales packages shown in FIGS. 7, 8 and 9 so as to keep the front face 243 in alignment with the faces of the retail product packages. The extension 258 can also provide support for the quadrate assembly 10 by holding on to the retail product packages that are adjacent the assembly 10. Indicia can be provided on the extension 258 to transition the indicia provided on the assembly 10 to the retail sales packages permitting the tie in of the offering.

Quadrate assembly 10 has a fourth panel 260 that has first and second longitudinal sides 262, 264 and first and second transversely extending end edges 266, 268. The fourth panel 260 has first and second faces 261 and 263. Fourth panel 260 has a tab 270 which extends in the longitudinal direction from end edge 268. Tab 270 is moveable about hinge 267. Fourth panel 260 is also provided with a die cut area or window 272 which is sized and configure so as to cooperate with window 256 enabling a side of the premium 100 to be visible though both windows 256 and 272. The fourth panel 260 is connected to the third panel 240 along hinge 265.

In forming the quadrate assembly 10 of the second embodiment described above and as illustrated in FIG. 5 extension 220 is folded about hinge 205 so that it is substantially perpendicular to first panel 200. The main portion 221 of extension 220 is folded about hinge 225 so that it lays parallel to panel 200. Tab 201 is folded about hinge 207 so that it is substantially perpendicular to panel 200.

Next, the second panel 230 is folded about hinge 207 so that panel 203 is substantially perpendicular to first panel 200. Tab 235 of panel 230 is folded about fold line 237 so that it is substantially perpendicular to panel 230.

The third panel 240 is then folded about hinge 249 so that panel 230 is substantially perpendicularly positioned with respect to panel 230 and overlies panel 200 in a parallel arrangement. The die cut area or window 256 of panel 240 comes into contact with the die cut area 223 of the extension 220.

Finally, the fourth panel 260 is folded about hinge 265 so as to come into contact with the back side of the extension 220 of panel 200 or face 203. This brings the die cut area 272 into overlapping contact with a portion of the die cut area 223 forming a side window in the quadrate assembly. Tab 270 is then folded about hinge 267 so that it is substantially perpendicular to panel 260.

Figure 6:
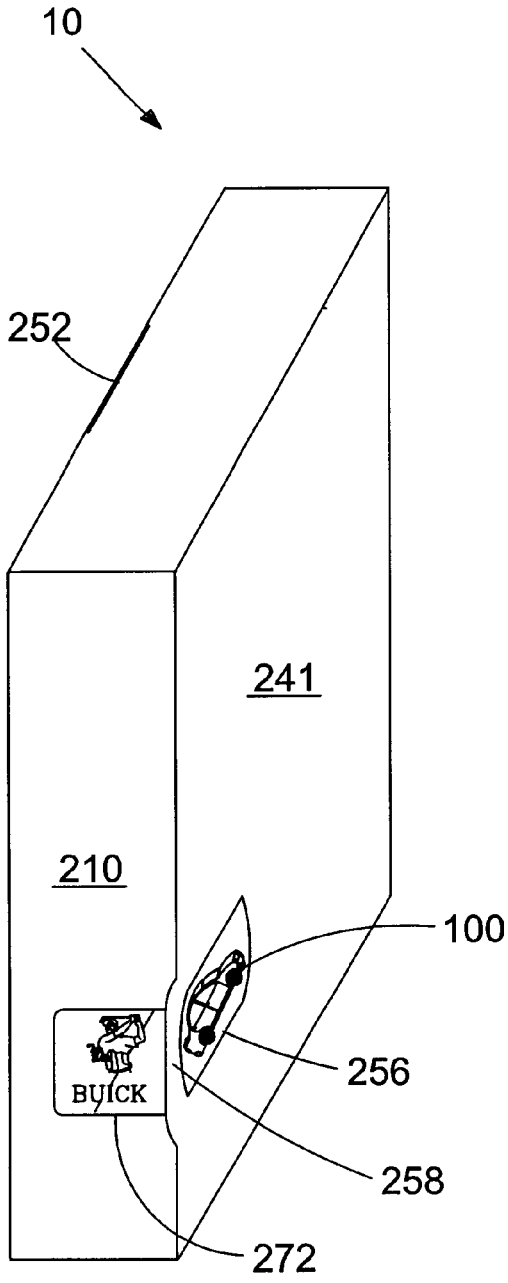
FIG. 6 is an illustration of the alternate embodiment in a folded condition and showing the premium in the window.

As shown in FIG. 6, the faces 231 and 263 of tabs 235 and 270 are in contact with the face 201 of tab 210, that is on the underside of the tab 210. Finally, tab 250 is folded about line 247 and extension 252 folded about hinge 253 so that tab 250 is brought into operative association with tab 210. That is face 241 of tab 250 rest on face 203 of tab 210. The extension 252 fits within the trapezoid die cut 212 of tab 210 to lock the tabs together.

Figure 5:
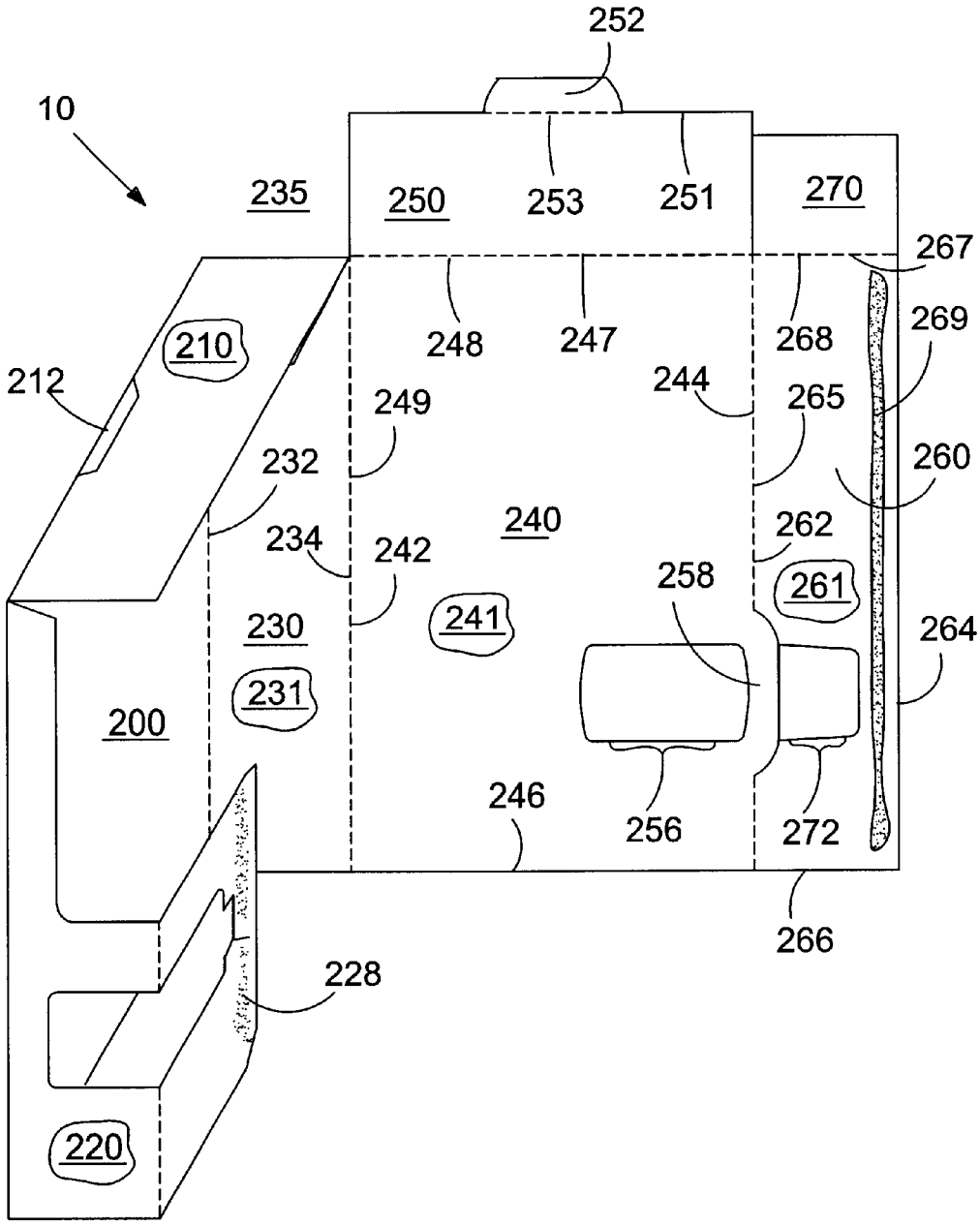
FIG. 5 is a view of the alternate embodiment of the quadrate assembly in a partially folded condition.

While the assembly 10 will retain the configuration it has been folded into, glue lines or adhesive spot welds may be added to secure the configuration either permanently or partially permanently together, as shown in FIG. 5. A first glue line is provided on the face 203 of extension 220 such that the glue line comes into contact with face 261 of panel 260 adjacent side 264. Additional glue lines or adhesive welds can be provided around window or die cut areas 256 and 272 to hold extension 220 in position.

The quadrate assembly of the present invention is preferably made of paperboard, however cardboard and plastic type material may also be used. Selection of the base material is contingent on the product or project with which the quadrate assembly is intended to be provided with.

Figure 7:
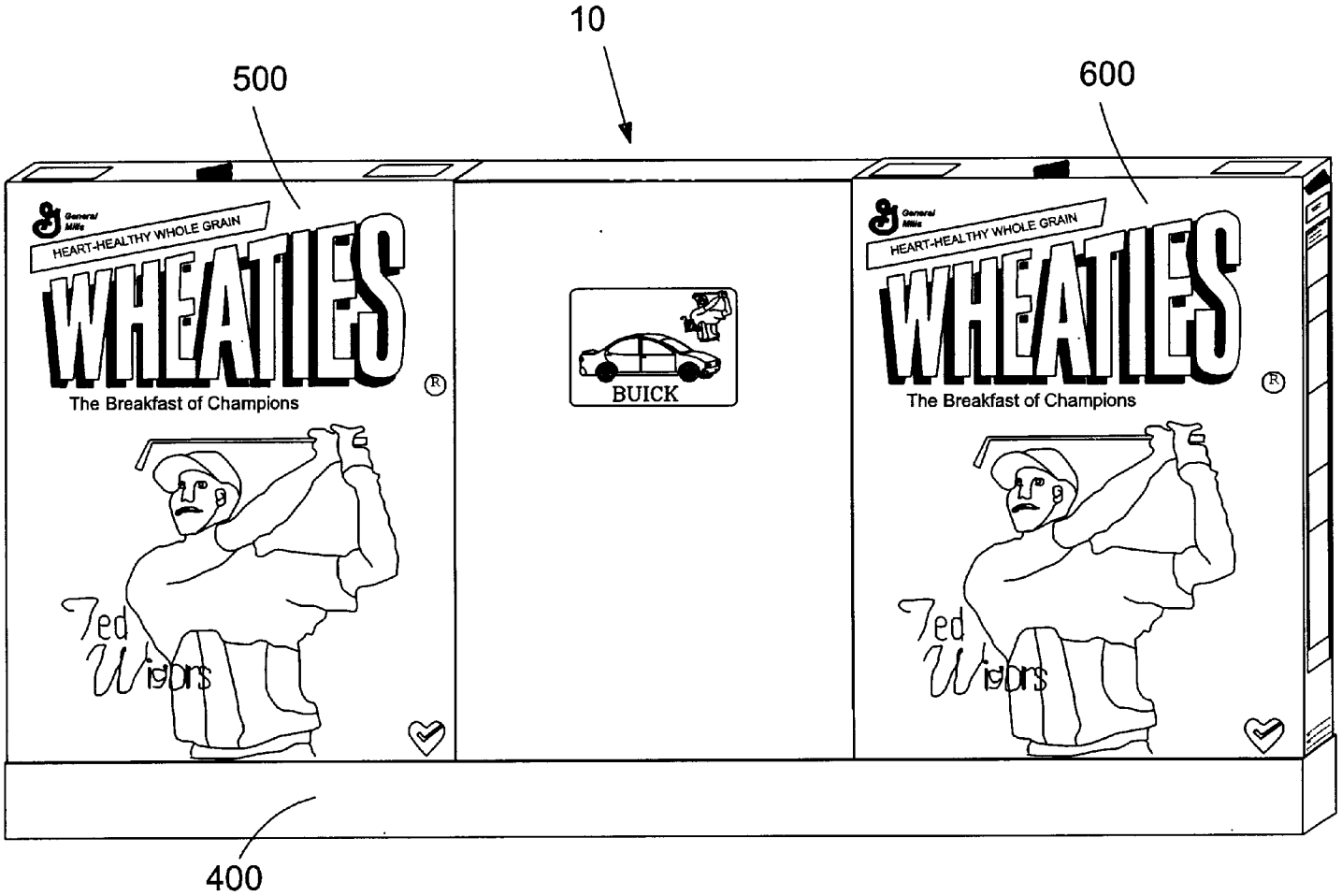
FIG. 7 depicts one embodiment of the present invention in a merchandise display package.

Turning to FIG. 7 the quadrate assembly 10 is shown in operative association with retail consumer package 500 and 600. Such retail consumer packages may include cereal, baking mixes, baking kits, flour, ready to eat meals and the like. While the retail consumer packages have been illustrated as generally rectangular in shape, other non-square or non-rectangular packages can also be provided.

Figure 8:
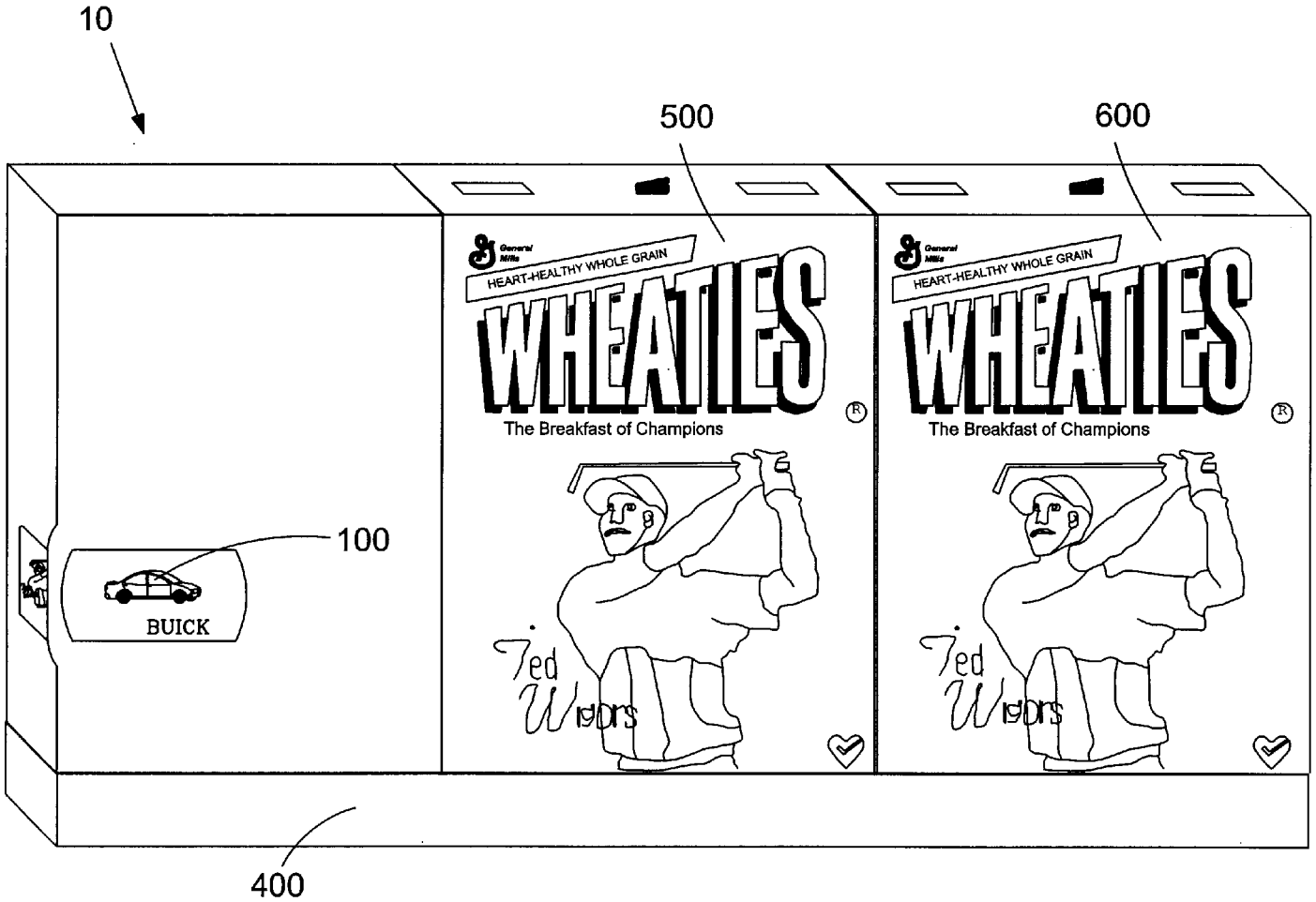
FIG. 8 depicts a further embodiment of the present invention in a merchandise display package.

As shown in FIG. 8 the retail packages 500 and 600 as well as the quadrate assembly 10 are held in position through the use of a "U" shaped channel 400. The channel 400 may also be constructed of paperboard, fiberboard, plastic or the like. Each complete arrangement of retail packages 500, 600 and quadrate assembly 10, positioned in channel 400 may then be wrapped in plastic film to hold the grouping together or in an alternative arrangement, the grouping may be held in position by spots of removable adhesive disposed on the sides of the containers. The product grouping may then be placed on a pallet or carrier for distribution to the retail outlet such as a grocery story, warehouse club, "super store" or the like.

Figure 9:
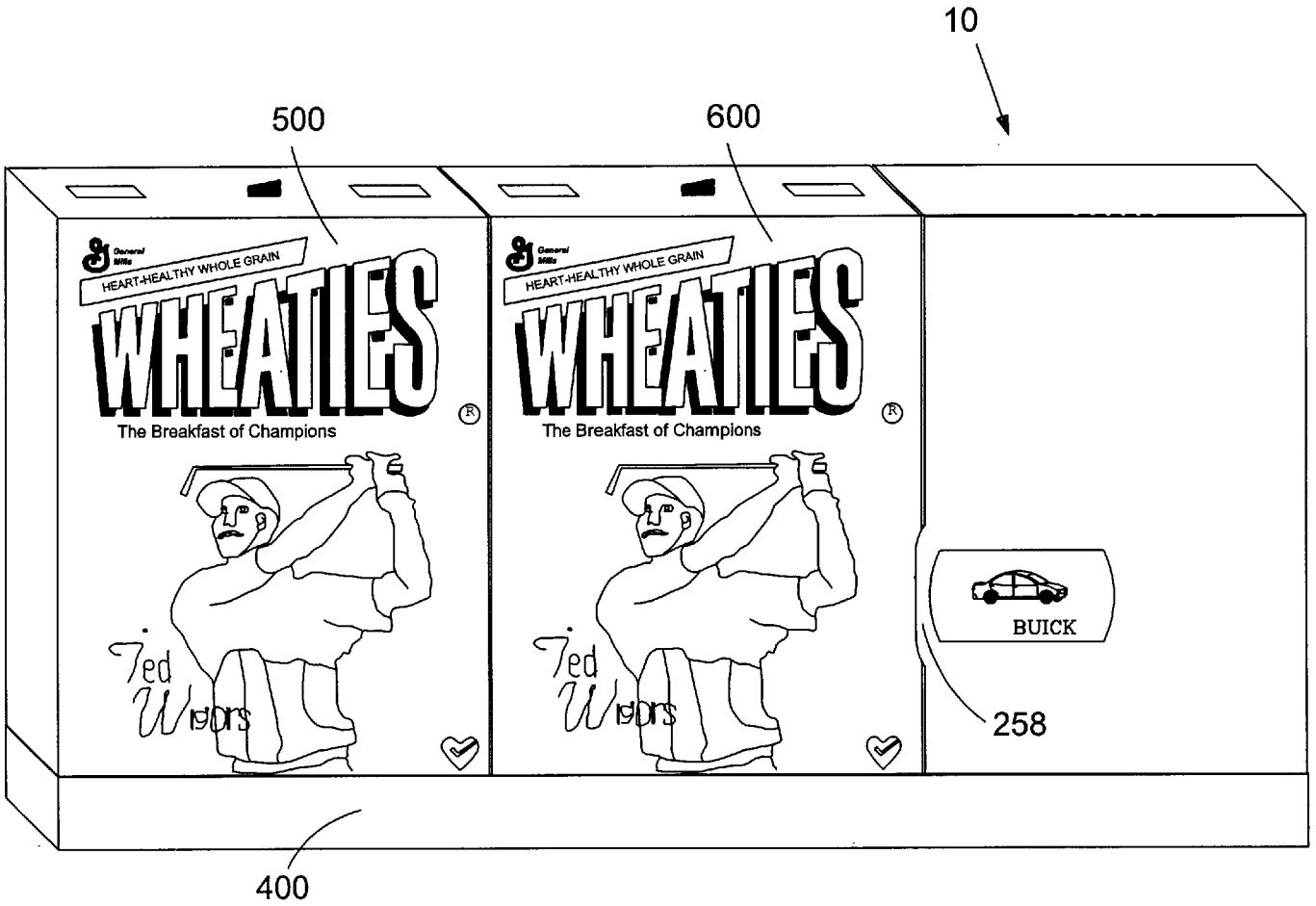
FIG. 9 depicts a still further embodiment of the present invention in a merchandise display package.

In FIG. 9, the quadrate assembly 10 is shown with extension 258 in operative engagement with one of the consumer packages illustrating the additional supporting feature provided by the invention in this configuration.

It will thus be seen according to the present invention a highly advantageous advertising quadrate assembly has been provided. While the invention has been described in connection with what is presently considered to be the most practical and preferred embodiment, it will be apparent to those of ordinary skill in the art that the invention is not to be limited to the disclosed embodiment, that many modifications and equivalent arrangements may be made thereof within the scope of the invention, which scope is to be accorded the broadest interpretation of the appended claims so as to encompass all equivalent structures and products.

What is claimed is:

1. A quadrate assembly, comprising;

At least first, second, third and fourth panels;

said first panel having first and second longitudinally extending sides and first and second transversely extending end edges, at least one of said first and second end edges having a tab extending in a longitudinal direction, said first panel having first and second faces, and said first panel having a first dimension;

said second panel having first and second longitudinally extending sides and first and second transversely extending end edges; at least one of said first and second end edges having a partially die cut tab extending longitudinally from said end edge; said second panel connected to said first panel along one of said first and second longitudinally extending sides, said second panel having first and second faces and said second panel having a second dimension distinct from said first dimension;

said third panel having first and second longitudinally extending sides and first and second transversely extending end edges, said third panel having a tab extending longitudinally from at least one of said first and second end edges, said third panel being connected to said second panel along one of said first and second longitudinally extending sides, said third panel having first and second faces and said third panel having a dimension substantially equal to said first panel;

said fourth panel having first and second longitudinally extending sides and first and second transversely extending end edges, said fourth panel having a first tab extending longitudinally from one of said first and second end edges, said fourth panel having a second tab extending from one of said first and second longitudinally extending sides, said fourth panel being connected to said third panel along one of said first and second longitudinally extending edges opposite said second tab, said fourth panel having first and second faces and said fourth panel having a dimension greater than said dimension of said first panel; and wherein one of said first, second, third and fourth panels has a die cut window therein and said one panel having a moveable tab which fits over but does not conceal said die cut window so as to enable as advertising premium to be supported in said assembly and be visible.

2. A quadrate package assembly as recited in claim 1, wherein said window is provided approximately adjacent one transversely extending end edge.

3. A quadrate package assembly as recited in claim 1, wherein said window is provided approximately adjacent one longitudinally extending side.

4. A quadrate package assembly as recited in claim 1, wherein said tab on said second panel is die cut to provide at least one moveable flap.

5. A quadrate package assembly as recited in claim 4, wherein said one moveable flap is brought in to contact with one of said first and second faces of said second panel.

6. A quadrate package assembly as recited in claim 1, wherein said tab on said second panel is die cut to form a slot.

7. A quadrate package assembly as recited in claim 1, wherein said second tab on said fourth panel is connected to one of said first and second longitudinally extending sides of said first panel opposite said one of said first and second longitudinally extending sides connecting said fourth panel to said first panel.

8. An intermediate assembly, comprising;

a substantially quadrate blank of material, said blank having first, second, third and fourth panels;

said first panel having first and second longitudinally extending sides and first and second transversely extending end edges, said first end edge having a tab extending in a longitudinal direction, said second end edge being substantially devoid of any tabs, said first panel having first and second faces, and said first panel having a first dimension;

said second panel having first and second longitudinally extending sides and first and second transversely extending end edges; said first end edge having a tab extending longitudinally from said first end edge, said second end edge being substantially devoid of any tabs; said second panel connected to said first panel along one of said first and second longitudinally extending sides, said second panel having first and second faces and said second panel having a second dimension distinct from said first dimension;

said third panel having first and second longitudinally extending sides and first and second transversely extending end edges, said third panel having a tab extending longitudinally from said first end edge having a tab extending in a longitudinal direction, said second end edge being substantially devoid of any tabs, said third panel being connected to said second panel along one of said first and second longitudinally extending sides, said third panel having first and second faces and said third panel having a dimension substantially equal to one of said dimensions of said first and second panels;

said fourth panel having first and second longitudinally extending sides and first and second transversely extending end edges, said fourth panel having a first tab extending longitudinally from said first end edge having a tab extending in a longitudinal direction, said fourth panel having a second tab extending from one of said first and second longitudinally extending sides, said second end edge being substantially devoid of any tabs, said fourth panel being connected to said third panel along one of said first and second longitudinally extending edges opposite said second tab, said fourth panel having first and second faces and said fourth panel having a dimension substantially equal to one of said dimensions of said first and second panels;

a die cut window provided in one of said first, second, third and fourth panels, said die cut window being sized and configured to receive a premium; and at least one of said tabs of said first, second, third and fourth panels having a first die cut therein that is sized and configured to cooperate with said die cut window, said one tab being moveable into cooperative engagement with said die cut window, and said one tab having a second die cut area to facilitate placement of the premium in the assembly.

9. An intermediate assembly as recited in claim 8, wherein a longitudinally extending flap is provided adjacent one of said first and second longitudinally extending sides of one said first, second, third and fourth panels.

10. An intermediate assembly as recited in claim 8 wherein said intermediate assembly is provided with adhesive to secure said assembly in a fold condition.

11. An intermediate assembly as recited in claim 8, wherein one of said tabs of said first, second, third and fourth panels is provided with a die cut sized and configured to receive an extension tab to form a closure.

12. A quadrate assembly, comprising;

At least first, second, third and fourth panels;

said first panel having first and second longitudinally extending sides and first and second transversely extending end edges, at least one of said first and second sides having a first partially die cut tab extending transversely from said side, said first die cut tab having a hinge bisecting said die cut tab into first and second sections, said first panel having first and second faces, and said first panel having a first dimension;

said first panel having a second tab, said second tab extending longitudinally from one of said first and second end edges;

said second panel having first and second longitudinally extending sides and first and second transversely extending end edges; said second panel having a tab extending longitudinally from one of said first and second end edges; said second panel connected to said first panel along one of said first and second longitudinally extending sides, said second panel having first and second faces and said second panel having a second dimension distinct from said first dimension;

said third panel having first and second longitudinally extending sides and first and second transversely extending end edges, said third panel having a tab extending longitudinally from at least one of said first and second end edges, said third panel being connected to said second panel along one of said first and second longitudinally extending sides, said third panel having first and second faces and said third panel having a dimension substantially equal to said first panel;

said fourth panel having first and second longitudinally extending sides and first and second transversely extending end edges, said fourth panel having a tab extending longitudinally from one of said first and second end edges, said fourth panel being connected to said third panel along one of said first and second longitudinally extending sides, said fourth panel having first and second faces and said fourth panel having a dimension less than said dimension of said first panel;

one of said first, second, third and fourth panels has a die cut window therein; and one of said first, second, third and fourth panels having a moveable tab which fits over but does not conceal said die cut window so as to enable as advertising premium to be supported in said assembly and be visible.

13. A quadrate assembly as recited in claim 12 wherein, a second die cut is provided in one of said first, second, third and fourth panels so as to permit a side of the premium to be visible.

14. A quadrate assembly as recited in claim 12 wherein, said first and second sections of said die cut tab of said first panel are of unequal length.

* * * * *